US006978793B1

(12) United States Patent
Krueger

(10) Patent No.: US 6,978,793 B1
(45) Date of Patent: Dec. 27, 2005

(54) PORTABLE CLEANING APPARATUS AND METHOD FOR SINGLE PASS PLATE AND FRAME HEAT EXCHANGERS

(75) Inventor: Kurt Krueger, East Lyme, CT (US)

(73) Assignee: PHEX LLC, East Lyme, CT (US)

( * ) Notice: Subject to any disclaimer, the term of this patent is extended or adjusted under 35 U.S.C. 154(b) by 321 days.

(21) Appl. No.: 10/443,609

(22) Filed: May 21, 2003

(51) Int. Cl.[7] ..... B08B 9/00

(52) U.S. Cl. ..... 134/169 R; 134/111; 134/166 R; 134/109; 165/5; 165/95; 165/166; 165/167

(58) Field of Search ..... 134/60, 104.1, 134/104.2, 104.3, 104.4, 105, 108, 109–111, 134/122 R, 166 R, 169 C, 169 R, 180, 175, 134/177; 165/95, 166, 167

(56) References Cited

U.S. PATENT DOCUMENTS

| | | | |
|---|---|---|---|
| 4,033,407 A | 7/1977 | Quintilliano | |
| 4,332,292 A | 6/1982 | Garberick | |
| 4,562,885 A | 1/1986 | Pausch | |
| 4,589,898 A | 5/1986 | Beaver | |
| 4,666,531 A | 5/1987 | Minard | |
| 6,058,974 A | 5/2000 | Blomgren | |

FOREIGN PATENT DOCUMENTS

| | | | | |
|---|---|---|---|---|
| EP | 000877222 A2 | | 11/1998 | |
| JP | 362037699 A | | 2/1987 | |
| JP | 07091881 A | * | 4/1995 | ..... F28G 1/04 |
| JP | 07159085 A | * | 6/1995 | ..... F28G 1/08 |
| JP | 07180990 A | * | 7/1995 | |
| WO | WO 99/45333 | | 1/1999 | |

* cited by examiner

*Primary Examiner*—Michael Barr
*Assistant Examiner*—Sarah E. Husband
(74) *Attorney, Agent, or Firm*—DeLio & Peterson, LLC; Robert Curcio

(57) ABSTRACT

A portable apparatus and method for chemically cleaning a single pass plate and frame heat exchanger allows the cleaning solution to be uniformly distributed across the plate pack. This portable system of one pump of preferably 10-horsepower, capable of 300 gallons per minute flow through a discharge port; at least two distribution/collection tubes with apertures of predetermined diameter and predetermined placement; one reversing manifold; two bag filters; and one circulation tank with a capacity at least on the order of 150 to 200 gallons; attaches to a single pass plate and frame heat exchanger. The single pass plate and frame heat exchanger is configured with at least two removable flanges that, once removed, allow for the installation of the distribution/collection tubes. The apertures in the distribution/collection tubes are placed facing downwards depending upon the direction of the operational fluid to enhance a vacuuming effect for particle and debris removal during cleaning. The distribution/collection tubes are skewed off-center of the flanges, with an ability to be rotated in at least four different directions off-center, and generally located towards the bottom of the single pass plate and frame heat exchanger to facilitate particulate removal and uniform distribution of cleaning solution.

20 Claims, 6 Drawing Sheets

PORTABLE CLEANING APPARATUS AND METHOD FOR SINGLE PASS PLATE AND FRAME HEAT EXCHANGERS

BACKGROUND OF THE INVENTION

1. Field of the Invention

The present invention relates to single pass plate and frame heat exchangers, and more specifically to an apparatus and method for chemically cleaning a single pass plate and frame heat exchanger without disassembly, with the use of portable, lightweight equipment.

2. Description of Related Art

Heat exchangers have been used to provide for domestic hot water, and in commercial, industrial, process, marine, aquaculture, HVAC, heat recovery, refrigeration, food and beverage processing, pharmaceutical, clean room, and many other applications for many years. One of the most common types of heat exchangers is the plate and frame heat exchanger. A plate and frame heat exchanger is generally comprised of a gasketed plate and frame construction. Gasketed plate and frame heat exchangers have a series of channeled plates that are mounted in a frame and clamped together. Each plate is commonly made from pressable materials, such as stainless steel, hastalloy, titanium, and the like. Each plate is further formed with corrugations and peripherally surrounded by an elastomeric gasket. The plate corrugations provide support between plates and encourage turbulence, which gives the plate and frame heat exchanger its high heat transfer. The gaskets are made of a suitable material generally for a specified thermal duty, and placed between the plates to contain the pressure, seal the fluid, and direct the flow. In a brazed-type plate heat exchanger, the gaskets are replaced with a brazed material, preferably copper or nickel, which allows for an increase in the operational pressure and temperature capabilities of the heat exchanger. The gasketed plates are assembled in a bundle or pack, mounted on upper and lower guide rails, and compressed between two end frames by compression bolts. The frame provides structural support and pressure containment by tightly enclosing the plate pack. The mainframe components generally consist of a fixed end, a movable end, upper carrying bar and lower guide bar, and tightening bolts. The end frames and heavy threaded rods compress the plate pack to create a highly efficient heat transfer device. The fluid flows through ports located on the frames. The location of these ports is generally dependent upon the particular flow characteristics required by the heat transfer application. The most common plate heat exchanger type is where the fluids pass through the heat exchanger in one direction only. This is referred to as a single pass unit, and in this configuration all of the inlet and outlet ports are located on the fixed end plate. FIG. 1 depicts a single pass plate heat exchanger 10 with arrow indications for the directional flow for the higher temperature fluid 12 and the lower temperature fluid 14. Fluid to fluid heat exchange is accomplished through both conductive and convective heat transfers. Conductive heat transfer is primarily a function of the heat transfer surface area. With plate and frame heat exchangers, increasing the surface area means adding plates. Convective heat transfer is a function of turbulence; the more turbulence, the more heat transfer.

As fluids pass through a plate and frame heat exchanger, certain fouling deposits will accumulate on the plate surfaces. This reduces the thermal efficiency of the heat exchanger. Dirt, microbiological material, iron oxide deposits, scale, and process contaminants will negatively impact almost any piping system if left to accumulate, including plate and frame heat exchangers. As deposits accumulate on the plate and frame heat exchanger plates, heat transfer efficiency is reduced and operating costs are increased. In most cases, the plate and frame heat exchanger is disassembled to pressure wash the plates. This procedure is time consuming and can easily take several days to complete when the heat exchanger contains several hundred plates. The pressure wash will remove many fouling deposits completely, but there are also many types of deposits that cannot be easily washed away. For certain types of hard deposits, the plates are normally removed from the frame and cleaned at a facility where they can be individually dipped in a chemical solution designed to dissolve the deposits. Moreover, other drawbacks to physical pressure washing may be realized. For example, the gaskets may separate from the plate surface and will need realignment before the plate and frame heat exchanger can be securely closed. Thus, after pressure washing, the gaskets and the adjacent sealing surfaces have to be inspected carefully to ensure that no debris is present. Debris on the gasket surface, even of a small nature, can cause the heat exchanger to leak when it is subsequently assembled and ready for operation. In this event, the heat exchanger would necessarily have to be reopened, rinsed, and re-closed. Furthermore, when the heat exchanger is opened, it has to be isolated from the system piping by closing the inlet and outlet valves for both fluids. Both fluids must then be drained, even if both sides of the heat exchanger are not fouled. In some cases, it would be beneficial not to drain the clean side fluid because it may be a toxic or hazardous material that must be contained. Furthermore, a brazed-type plate heat exchanger cannot be taken apart and cleaned in this manner.

Given the significant limitations of pressure washing individual plates, manufacturers have opted for a continuing, multistage chemical cleaning program using aggressive chemical agents. Chemical cleaning usually requires a period of exposure within the system to dissolve and flush deposits, and then to neutralize the system. Plate and frame heat exchanger manufacturers generally recommend chemically cleaning without opening the heat exchanger. As typically recommended by a plate and frame heat exchanger manufacturer, the cleaning solution is pumped into an existing heat exchanger inlet and returned to a circulation tank from an existing heat exchanger outlet. Problematically, unless a large high-pressure pump is used to force the chemical solution through the plate and frame heat exchanger, there is generally an insufficient flow rate that prevents the cleaning solution from reaching the opposite end of the heat exchanger. In effect, using even the most powerful portable pumps available in the industry today, the pumped cleaning solution is "short circuited" by the mass and inertia of the existing fluid downstream within the heat exchanger that the cleaning solution must ultimately move and replace. FIG. 2 depicts a plate frame heat exchanger 20 with cleaning solution applied under pressure at inlet point 22. Flow circuit 24 is the desired result, having the cleaning solution traverse to the opposite end of the heat exchanger and up through the plates, and return at outlet point 26. However, flow circuit 28 represents the more common situation of cleaning solution flow, where the input cleaning solution, under portable pump pressure does not have, nor can it deliver, enough force or pressure to move through to the end of the heat exchanger, which leaves the plates at the end of the plate pack with little or no exposure to the cleaning solution. Since flow circuit 28 represents the path of least resistance for the cleaning solution under portable pump pressure and flow rate, flow circuit 24 is never realized. To achieve enough flow to allow proper distribution across all of the plates would require a pump that was almost as large as the system pump, and a large circulation tank with large hose attachments. This would also require a large footprint in the mechanical room, and would not be portable to any other heat exchanger elsewhere in the facility. Using a smaller portable system with its standard pump, a uniform distribution flow of cleaning solution throughout each heat exchanger plate cannot be realized. Nor can debris of any significant size be readily removed or vacuumed under the standard portable configuration.

Some prior art techniques for introducing fluids or gases in plate heat exchangers have been attempted, although none have been introduced for the large single pass plate and frame heat exchangers. For example, in U.S. Pat. No. 4,562,885 issued to Pausch on Jan. 7, 1986 entitled, "PLATE HEAT EXCHANGER AND PRESSURE BLAST CLEANER," a plate heat exchanger is disclosed having a plurality of parallel channels for conveying heated gases. A pressure tank is positioned adjacent the housing, and is in flow communication with the interior of the housing via a plurality of jet pipes. Each of the jet pipes has a closed end and a plurality of air jet passages or nozzles formed along one surface. Each jet pipe center is positioned between a pair of open-ended plates. Jet nozzles face toward the open-ended area. Although Pausch teaches a number of pipes having a plurality of passages or nozzles for cleaning a plate heat exchanger, the apparatus requires many pipes, one for each opening between the plates, which could not be realistically utilized in large plate and frame heat exchangers without significant redesign. Furthermore, in Pausch, the air jet passages or nozzles within each pipe are designated along the opening between two plates, and not transverse to this direction. By Pausch's design, a pipe is needed for every space or opening between plates, and the plurality of nozzles for each pipe are dedicated to one opening. Furthermore, Pausch's invention is designed to administer multiple air blasts resulting in a sonic wave of pressurized air forming downstream of the jet pipe, and passing through the airflow channel with which the jet pipe is aligned. It is not designed for reverse extraction of applied cleaning fluid or debris.

In European Patent No. EP 0877222A2 issued to Sabin on Nov. 11, 1998, entitled "DEVICE FOR INJECTING PRESSURIZED FLUIDS IN A PLATE-LIKE HEAT EXCHANGER AND PROCESS FOR CLEANING THIS INJECTION DEVICE," an injection tube is disclosed having calibrated orifices, and extending over a plate bundle. The injection tube has a closed end and an open end connected to a supply pipe. The open end is connected to a pipe for evacuating particles deposited on a filter placed inside the tube. Two identical tubes are used. One is shown towards the top of the heat exchanger, while the other is situated along the bottom of the plates. As shown, Sabin does not teach or disclose using this apparatus for a plate and frame heat exchanger. Nor does Sabin teach of positioning the apertures of one cleaning tube directionally with respect to the other tube's apertures to facilitate particulate removal. In fact, if a reverse cleaning solution flow were attempted using the Sabin design, Sabin's filters would prevent particulates within the plate heat exchanger from exiting the tubes. Consequently, the Sabin design cannot accomplish reversing the cleaning fluid flow and extracting particulates from a plate and frame heat exchanger.

U.S. Pat. No. 4,666,531 issued to Minard on May 19, 1987 entitled, "DEVICE AND METHOD FOR CLEANING FIN-TYPE HEAT EXCHANGERS IN AIR DUCTS," discloses a cleaning system having a pair of tubes mounted horizontally across an air duct. Plastic tubes are mounted on the downstream and upstream sides, respectively, of the heat exchanger. The tubes also run parallel to the edges of the fins. Tubes are shown having a plurality of slots extending longitudinally along the tube outer diameter in two closely spaced rows. The slots are cut to produce a fan-shaped spray, as liquid from tube sprays through the slots. In Minard, both tubes are located at the top of the air duct, and used for cleaning and rinsing fluid ingress. Neither tube is situated or utilized for fluid extraction. Furthermore, the cleaning fluid travels from alternate tubes at the top, and traverses down the plates under the force of gravity. Minard also does not teach or disclose any particular positioning of the slotted tubes such that debris is less likely to clog them and restrict fluid extraction. Nor does Minard does teach or disclose the aperture placement on the tubes for fluid egress.

Bearing in mind the problems and deficiencies of the prior art, it is therefore an object of the present invention to provide a portable apparatus and method for cleaning plate and frame heat exchangers that allows for substantially uniform disbursement of a chemical cleaning solution to each of the plates in the heat exchanger.

It is another object of the present invention to provide a portable apparatus and method for cleaning plate and frame heat exchangers that extracts and removes measurable particulates from the heat exchanger during cleaning.

A further object of the invention is to provide a portable apparatus and method for cleaning plate and frame heat exchangers that provides for reverse extraction of the applied cleaning fluid.

It is yet another object of the present invention to provide a portable apparatus and method for cleaning plate and frame heat exchangers that diminishes the amount of clogging due to debris, and thus facilitates fluid extraction during cleaning.

Still other objects and advantages of the invention will in part be obvious and will in part be apparent from the specification.

SUMMARY OF THE INVENTION

The above and other objects, which will be apparent to those skilled in art, are achieved in the present invention, which is directed to in a first aspect, an apparatus for cleaning a single pass plate and frame heat exchanger having a moveable frame plate end, the apparatus comprising: the single pass plate and frame heat exchanger having at least two removable flanges having a center and an off-center hole therethrough for installation of distribution/collection tubes, the flanges secured by bolting and capable of rotation such that the hole may be located above, below, left or right of the center; a lower distribution/collection tube with a plurality of apertures therethrough, the apertures including predetermined diameters and predetermined spacing, and the lower distribution/collection tube capable of being located off-center of the flange in at least four positions; an upper distribution/collection tube with a plurality of apertures therethrough, the apertures including predetermined diameters and predetermined spacing; a plurality of connecting hoses; a portable pump connected to a reverse manifold valve network through a portion of the plurality of connecting hoses; a circulation tank connected to the portable pump through a portion of the plurality of connecting hoses; the upper and lower distribution/collection tubes connected to the reverse manifold valve network, each of the distribution/collection tubes connected through a portion of the plurality of connecting hoses; a bag filter connected to the reverse manifold valve network and to the circulation tank. The lower distribution/collection tube may be installed such that the apertures are downward facing and skewed downward off-center by placement of the flange. The aperture predetermined diameter is determined such that a cumulative aperture cross sectional area is approximately less than or equal to a cross sectional area of one of the distribution/collection tubes. The apertures of the upper distribution/collection tube downward facing when operational flow of the single pass plate and frame heat exchanger is in a top-to-bottom direction, and upwards facing when operational flow of said single pass plate and frame heat exchanger is in a bottom-to-top direction.

In a second aspect, the present invention is directed to an apparatus for cleaning a single pass plate and frame heat exchanger having a movable frame end plate and a fixed frame end plate, the apparatus comprising: the single pass plate and frame heat exchanger including at least two removable flanges on the movable frame end plate, the at least two removable flanges including an upper flange and a lower flange, the upper and lower flanges removed for insertion of at least one upper distribution/collection tube and at least one lower distribution/collection tube, respectfully; a portable pump for pumping cleaning solution through the distribution/collection tubes into and out of the single pass plate and frame heat exchanger; at least two distribution/collection tubes including the at least one upper distribution/collection tube and the at least one lower distribution/collection tube, each distribution/collection tube including a plurality of apertures having predetermined diameter and predetermined spacing, the at least two distribution/collection tubes aligned such that the apertures are in a generally downward facing direction in the at least one lower distribution/collection tube, and the apertures are downward facing in the at least one upper distribution/collection tube when operational flow of the single pass plate and frame heat exchanger is from top-to-bottom; at least one bag filter designed to remove non-dissolved particles and debris from the cleaning solution; a plurality of attaching hoses, the hoses designed to hold and carry the cleaning solution to and from a circulation tank, the bag filter, a reversing manifold, the pump, and the distribution/collection tubes within the single pass plate and frame heat exchanger; the circulation tank connected to the bag filters; and the reversing manifold including a plurality of valves designed to reverse the flow of the cleaning solution from the bottom-to-top directional flow to the top-to-bottom directional flow with respect to the single pass plate and frame heat exchanger. The removable flange plates may be replaced with flange plates having a nippled formation adapted for insertion and connection of the distribution/collection tubes, such that the flange plates' nippled formation is capped under normal operation of the single pass plate and frame heat exchanger when the distribution/collection tubes are removed, the nippled formation being located off-center in at least one of the flange plates. The distribution/collection tubes may have a permanent flange plate attached thereto, such that the removable flange is replaced with the distribution/collection tube permanent flange plate when the distribution/collection tube is installed. The aperture predetermined spacing may be analytically determined from the single pass plate and frame heat exchanger's plate pack length. The aperture predetermined diameter may be determined such that a cumulative aperture cross sectional area is approximately less than or equal to a cross sectional area of one of the distribution/collection tubes. The apparatus may include having four of the removable flanges, one at each corner of the single pass plate and frame heat exchanger. The upper and lower distribution/collection tubes may be skewed off-center with respect to the flanges' center, with the distribution/collection tubes and the apertures directed towards the single pass plate and frame heat exchanger's bottom depending upon direction of the operational flow.

In a third aspect, the present invention is directed to a method for cleaning a single pass plate and frame heat exchanger, having a moveable frame end plate and a fixed frame end plate, the method comprising: shutting down the single pass plate and frame heat exchanger; removing flanges from the single pass plate and frame heat exchanger from the moveable frame end plate; installing upper and lower distribution/collection tubes in place of the removed flanges, such that apertures in the lower distribution/collection tube are generally downward facing; connecting a reverse manifold valve network having a plurality of valves adaptable for forward and reverse directional flow of the cleaning solution to the upper and lower distribution/collection tubes at the single pass plate and frame heat exchanger; connecting one end of a portable pump to a first port of the reverse manifold valve network and the other end of the portable pump to a circulation tank filled with cleaning solution; connecting at least one bag filter at a first port to the upper distribution/collection tube at one end through a second port of the reverse manifold valve network and to the circulation pump at a second end at a second port of the at least one bag filter; activating the portable pump to apply pressure to the cleaning solution to move the cleaning solution through the single pass plate and frame heat exchanger in a bottom-to-top directional flow; changing the valves on the reverse manifold valve network to reverse the directional flow of the cleaning solution; and activating the portable pump to apply pressure to the cleaning solution to move the cleaning solution through the single pass plate and frame heat exchanger in a top-to-bottom directional flow. The method may further comprise installing the distribution/collection tubes such that the upper distribution/collection tube is skewed off-center of the flange, downward facing with respect to the single pass plate and frame heat exchanger when operational flow is in a top-to-bottom direction, and upwards facing when operational flow of said single pass plate and frame heat exchanger is in a bottom-to-top direction.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–9 of the drawings in which like numerals refer to like features of the invention.

Figure 1:
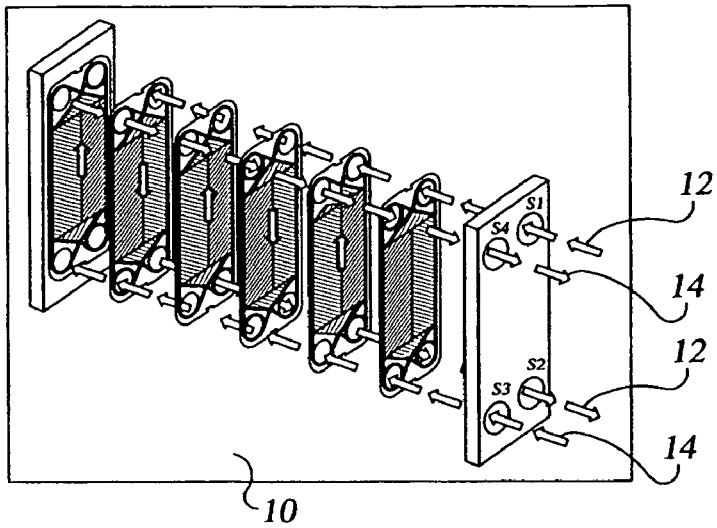
FIG. 1 is a drawing of a single pass plate and frame heat exchanger with arrow indications for direction flow of operational fluids.
Figure 2:
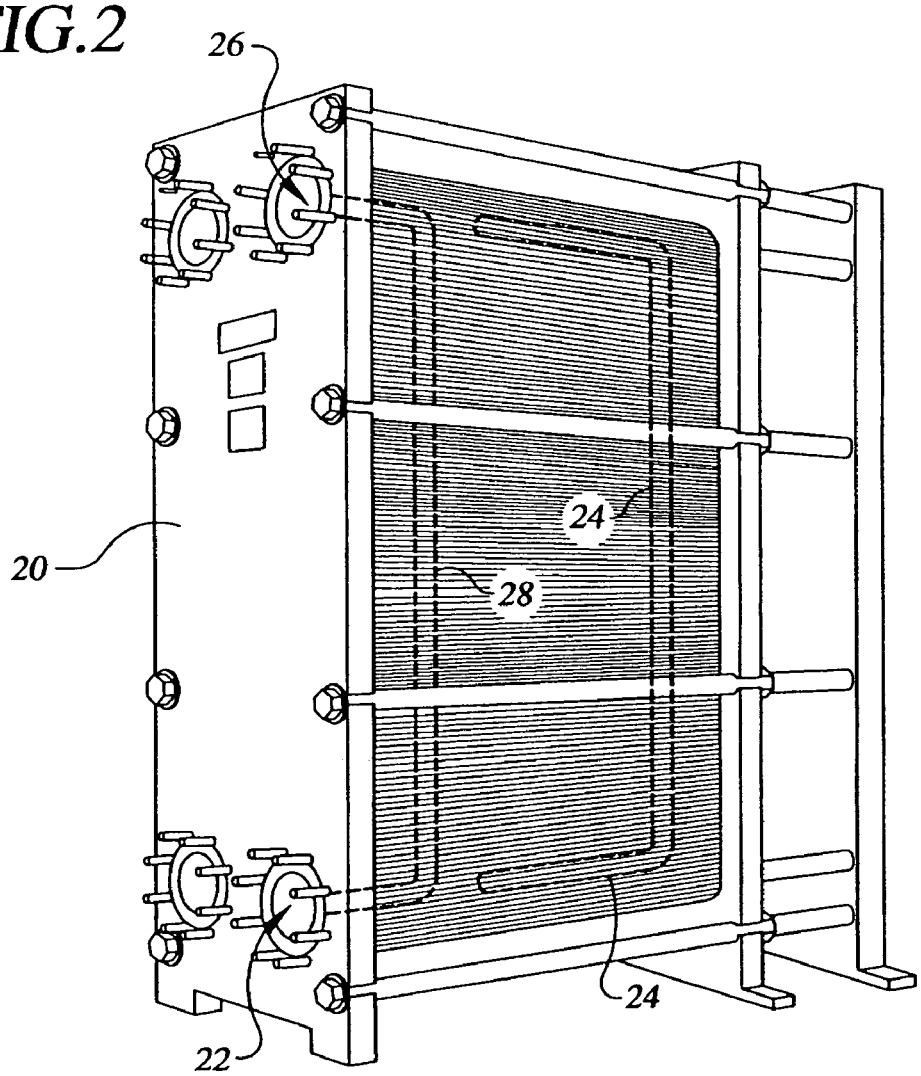
FIG. 2 depicts a plate and frame heat exchanger demonstrating the directional flow of cleaning fluid applied under pressure.
Figure 3:
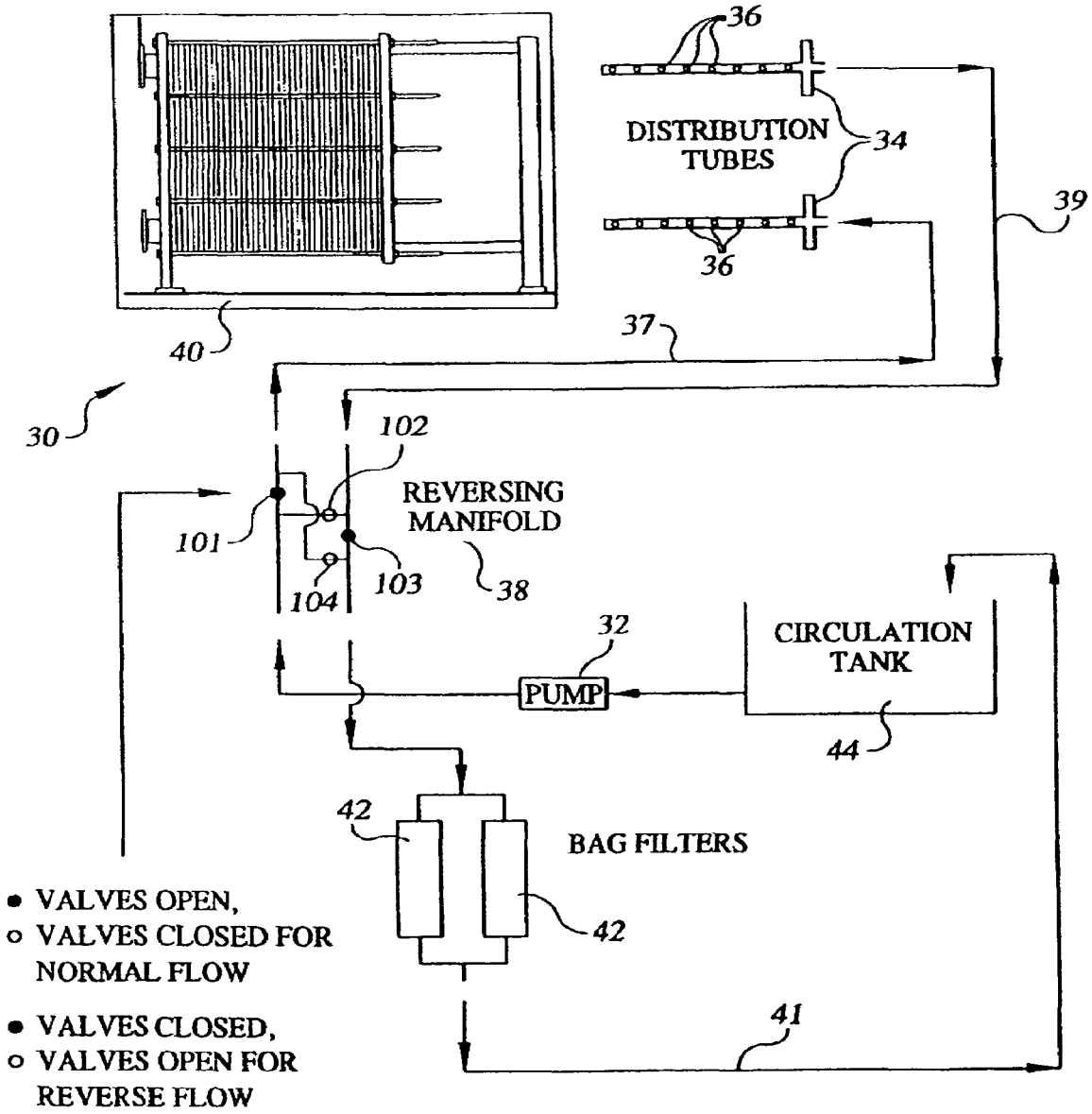
FIG. 3 depicts the single pass plate and frame heat exchanger cleaning apparatus of the present invention.

The present invention provides for a portable apparatus and method for chemically cleaning a single pass plate and frame heat exchanger that allows the cleaning solution to be uniformly distributed across the plate pack. FIG. 3 depicts the smaller, portable cleaning apparatus employed in the present invention for the chemical cleaning of heat exchangers. This portable system 30 attaches to a plate and frame heat exchanger 40 and comprises one pump 32 of preferably 10-horsepower, capable of 300 gallons per minute flow through a discharge port approximately 2 inches in diameter; at least two distribution/collection tubes 34 approximately 2 inches in diameter and having apertures 36 of predetermined diameter and predetermined placement; one reversing manifold 38; two filters 42, preferably 2-inch bag filters each capable of approximately 160 gallons per minute; and one circulation tank 44 with a capacity at least on the order of 150 to 200 gallons.

Figure 4:
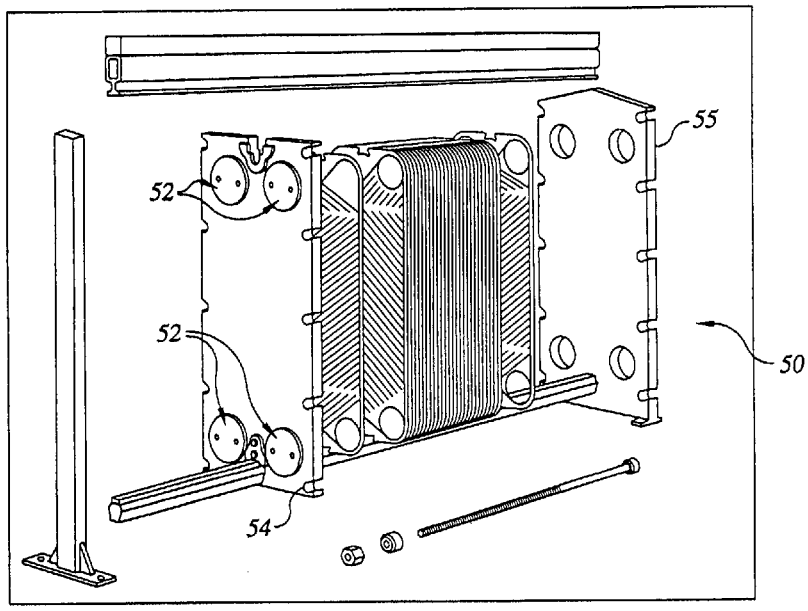
FIG. 4 is a drawing of a single pass plate and frame heat exchanger situated with access ports on the movable frame end.
Figure 5:
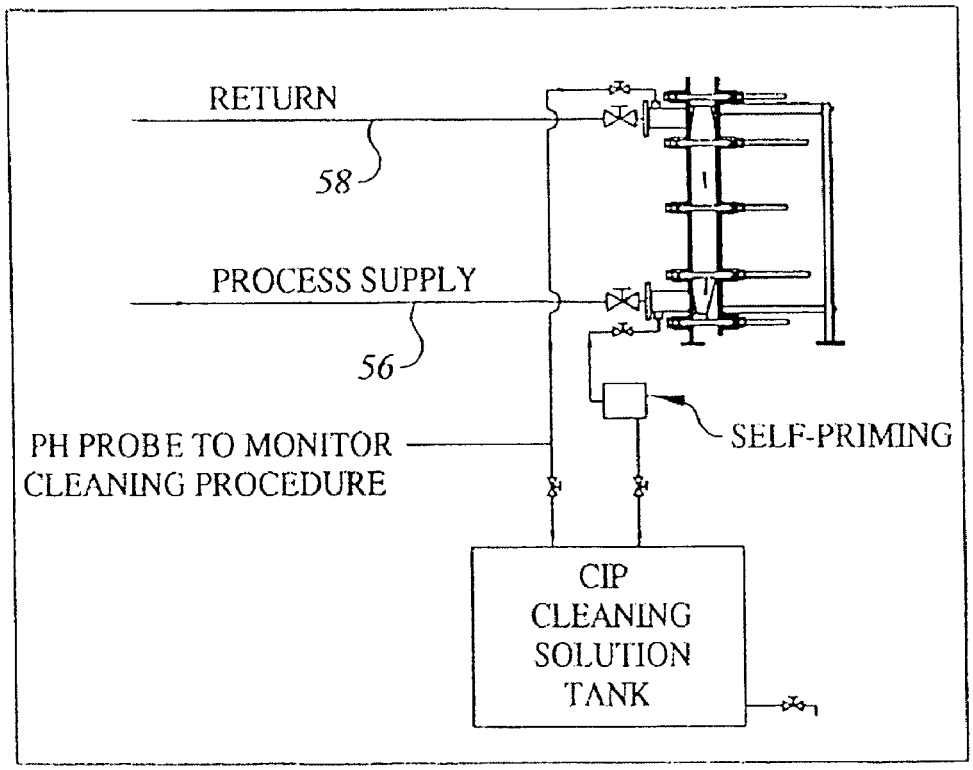
FIG.5 (PRIOR ART)
FIG. 5 depicts a prior art schematic of pumping cleaning solution into and out of the existing piping on a fixed frame plate end.

The present invention is designed for single pass plate and frame heat exchangers; thus, importantly, the distribution/collection tubes must be inserted from the movable frame plate end because the heat exchanger system pipes are connected to the fixed frame plate end. This is contrary to the standard cleaning methodology for these types of heat exchangers where the cleaning solution is introduced through the fixed frame plate end. As indicated by FIG. 4, the plate and frame heat exchanger 50 is situated with access ports or blank flange plates 52 on the movable frame plate 54. The water pipes connect on the fixed frame plate side 55. The cleaning solution is pumped into and out of the single pass plate and frame heat exchanger from the rear side as opposed to pumping the cleaning solution through the existing piping at the fixed frame plate end. FIG. 5 depicts a prior art schematic of pumping the cleaning solution into and out of the existing piping on the fixed frame plate, into the process supply 56 and return lines 58. In contrast, the present invention is employed on the moveable frame plate end.

Figure 6:
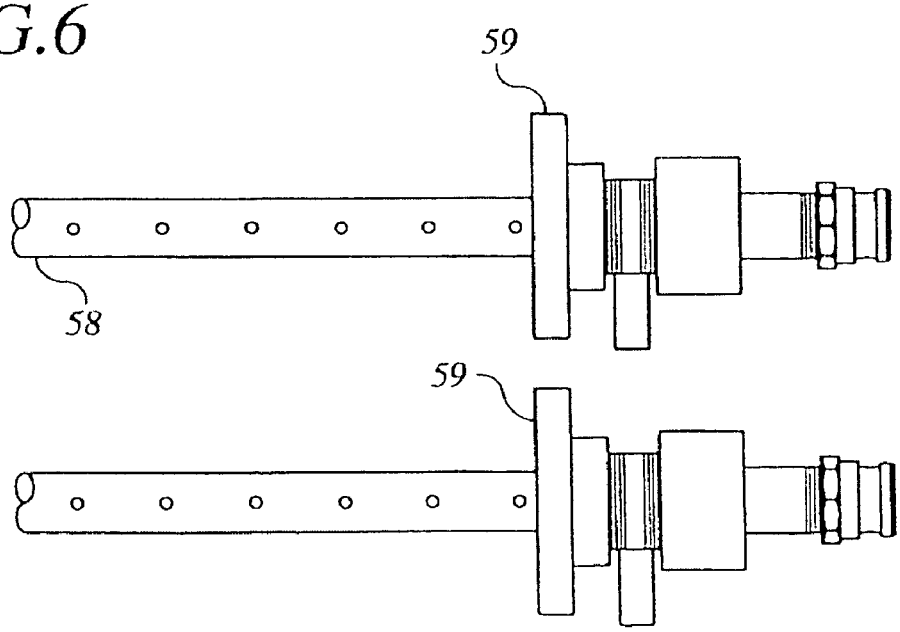
FIG. 6 depicts a distribution/collection tube of the present invention with a permanent flange plate attached thereto.
Figure 7:
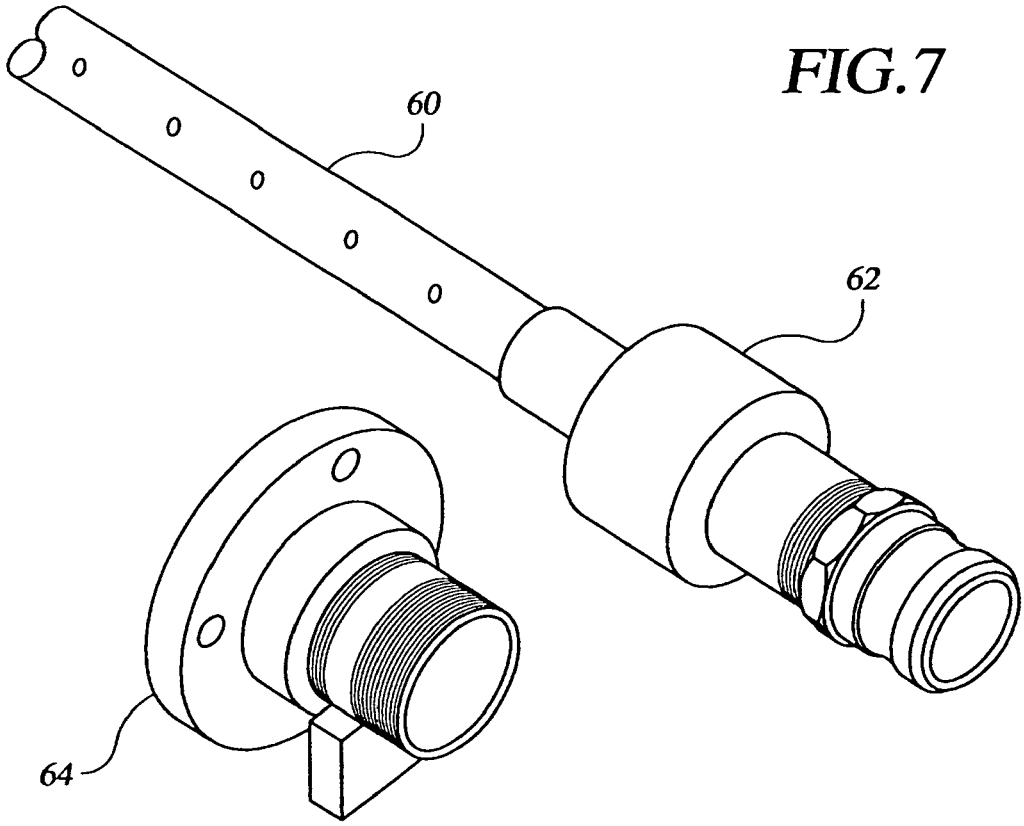
FIG. 7 depicts a distribution/collection tube of the present invention with a mount for installation on a nippled flange plate.
Figure 8:
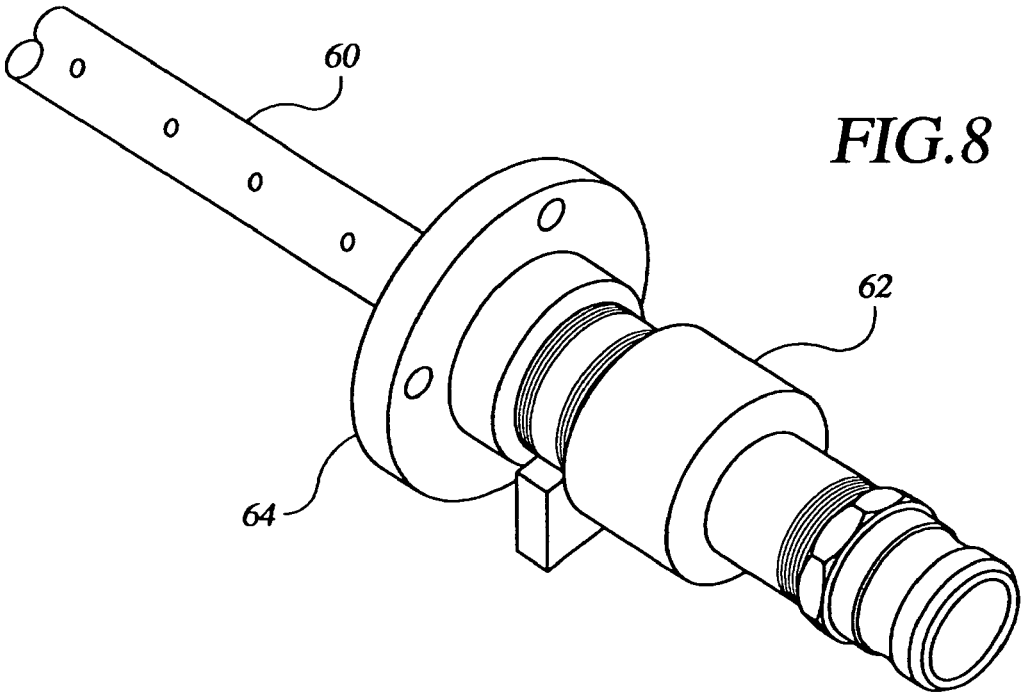
FIG. 8 illustrates the connection of the distribution/collection tube of FIG. 7 to the nippled flange plate.

Connection of distribution/collection tubes to the moveable frame plate end may be accomplished in several ways. The distribution/collection tubes may be permanently attached to a flange plate to replace the blank flange plates 52 on the heat exchanger. FIG. 6 depicts two distribution/collection tubes 58 of the present invention with permanent flange plates 59 attached thereto. Alternatively, the flange plates on the moveable frame plate may be installed with permanently mounted nipples for insertion of the distribution/collection tubes. During normal operation, the nipples would be capped. FIG. 7 depicts a distribution/collection tube of the present invention 60 with mount 62 for installation on a nippled flange plate 64. FIG. 8 illustrates the connection of the distribution/collection tube 60 with the nippled flange plate 64 attached. Preferably, the flanges on the moveable frame plate are installed with permanently mounted 3-inch nipples for capping and subsequent attachment of the distribution/collection tubes. For heat exchanger cleaning, the distribution/collection tubes would be attached as shown in FIG. 8.

The distribution/collection tubes are installed for the cleaning procedure, and are removed once the cleaning procedure has been completed. Importantly, the present invention allows for the design and orientation of distribution/collection tubes that provide for a uniform distribution of cleaning fluid, even under low flow rate conditions, throughout the entire heat exchanger. This results in the complete cleaning apparatus being much smaller and more portable than those of the existing art.

Apertures are drilled into the distribution/collection tubes. They are designed for a cumulative area that is preferably the same or less than the cross-sectional area of the distribution/collection tube. This will result in the same amount of cleaning fluid coming out of and going into each aperture with the total flow rate approximately equal to the full capacity of the pump. For example, a 2-inch distribution/collection tube would have a cross-sectional area of $3.14\cdot(1)^2=3.14$ square inches. If a number of ½-inch diameter apertures are drilled into a distribution/collection tube of this cross-sectional area, each aperture having a cross-sectional area of approximately 0.196 square inches, preferably no more than sixteen (16) apertures would be drilled into the tube ($16\cdot0.196$ sq. in.$\leqq 3.14$ sq. in.). Table I lists the number of apertures on each 2-inch diameter distribution/collection tube for various aperture diameters, and the number of spaces between each aperture.

TABLE I

Number and Size of Apertures For 2-inch Distribution/Collection Tube

| Aperture Diameter | Number of Spaces | Number of Apertures/Tube |
|---|---|---|
| ⅝" | 9 | 10 |
| 9/16" | 11 | 12 |
| ½" | 15 | 16 |
| 7/16" | 20 | 21 |
| ⅜" | 27 | 28 |

Preferably, the aperture diameter is of the predetermined range between ⅜" and ⅝". Apertures in this range will provide for pickup of approximately 99% of the suspended solids and debris normally found in a plate and frame heat exchanger. Apertures smaller than this will physically limit the size of the solids that can be picked up and filtered away. Apertures much larger than this range will reduce the velocity of the solution flowing through the tubes. As velocity is reduced, particles of higher specific gravity will not be accumulated by the system. Moreover, apertures in this predetermined diameter range will be well suited for the varying lengths of the plate packs normally found in single pass plate and frame heat exchangers.

Beneficially, the drilled apertures in the distribution/collection tube are evenly spaced; however, testing has shown that the aperture spacing should be no more than 4-inches. The vacuuming effect from each aperture will cover the distance in between adjacent apertures at the spacing, such that all debris present can be accumulated. Importantly, an aperture should also be placed at both extreme ends of each distribution/collection tubes. This design will allow for a uniform, constant flow of cleaning solution from each of the small apertures.

One method for determining the size and spacing of the apertures is to first divide the plate pack length by four inches (the maximum distance between apertures) to calculate the minimum number of spaces. For example, if the plate pack length is 52", the minimum number of spaces required is 13. Referring to Table I, 15 spaces would be chosen as the first correlated calculation. This corresponds to a ½" diameter aperture with 3.47" (52"/15 spaces) between apertures. Thus, the distribution/collection tubes in this example would have 16½" diameter apertures with one aperture at each end. The total cross-sectional area of the apertures is 3.14 sq. in. The area of the 2-inch distribution/collection tube is also 3.14 sq. in., enabling the flow of the cleaning solution to be uniform throughout the length of the tube.

The present invention allows for efficient cleaning using the smallest equipment possible for portability. For a 10-horsepower pump with a 2-inch outlet port, a 2-inch connecting hose would allow for a pumping rate of approximately 300 gallons per minute. Importantly, the predetermined size and number of apertures in the distribution/collection tubes do not hinder the flow of the cleaning solution, or create a non-uniform or uneven flow.

The distribution/collection tubes are then inserted at the plate and frame heat exchanger inlet and outlet flanges. Importantly, the distribution/collection tubes at the bottom of the heat exchanger are positioned such that the small apertures drilled into them are facing downward. When the circulation pump is turned on, the cleaning solution is first pumped from the bottom of the heat exchanger, flowing towards the heat exchanger top under the pump's pressure. This is shown in FIG. 3 as the first flow path 37 through the reversing manifold 38. The cleaning fluid enters the bottom of the plate pack area and is distributed uniformly across all of the plates as a result of the aperture downward placement on the lower distribution/collection tube. As the cleaning solution rises to the top of the heat exchanger, it is then collected in the upper distribution/collection tube. The cleaning solution returns through flow path 39 and traverses to bag filters 42. The bag filters are designed to remove any non-dissolved debris and return the solution to the circulation tank through path 41. Cleaning in this direction is preferably continued for several minutes to ensure that all of the internal surfaces have been wetted and that all the air is purged from the heat exchanger. The direction of the cleaning solution is then reversed by operating valves on the reversing manifold 38. Valves 101 and 103 are open for forward flow and closed for reverse flow, while valves 102 and 104 are closed for forward flow and open for reverse flow. A reverse flow will move the cleaning solution from the top of the plate and frame heat exchanger towards the bottom. Because the apertures in the lower distribution/collection tube are facing downwards, non-dissolved debris will be pushed into the distribution/collection tubes and removed from the circulating cleaning solution by the bag filters. The direction of the cleaning solution flow is alternated throughout the cleaning process to remove thoroughly the non-dissolved debris from the heat exchanger. By employing a reversing manifold, each of the distribution/collection tubes separately becomes a distribution or collection tube depending upon the directional flow of the cleaning solution. The length of the cleaning procedure will depend upon the amount and type of fouling present, and the cleaning solution used. In most cases, the cleaning can be accomplished in a few hours. The cleaning is determined to be complete when there is no further reduction in the concentration of the cleaning solution, i.e., there are no further deposits to dissolve. This can be verified by measuring the pressure drop across the cleaned side when the plate and frame heat exchanger is returned to service. A pressure drop near or equal to the heat exchanger's designed pressure drop indicates that fouling is no longer present. Importantly, the present invention allows for complete cleaning of a plate and frame heat exchanger without having to drain both operational fluids of the heat exchanger. This is advantageous when there is no need to drain the clean side fluid, which may be toxic or hazardous material.

The distribution/collection tubes are installed for cleaning purposes, and removed thereafter for normal heat exchanger operation. In contrast to cleaning systems that inject a cleaner into the existing flow stream of the heat exchanger's operating fluid, or one that uses a chemical solution on a "once through" basis, the present invention re-circulates the cleaning solution until it is exhausted, or the plate deposits have been dissolved. By utilizing distribution/collection tubes with predetermined, downward facing apertures, a low flow rate can be employed that will still ensure uniform and complete distribution throughout the plates. This makes it possible to filter approximately 100 percent of the re-circulating solution with relatively small, portable bag filters. The bag filters are exceptionally efficient for removal of suspended solids that would not be possible with side stream filtration, where only a portion of the re-circulated solution is filtered.

Figure 9:
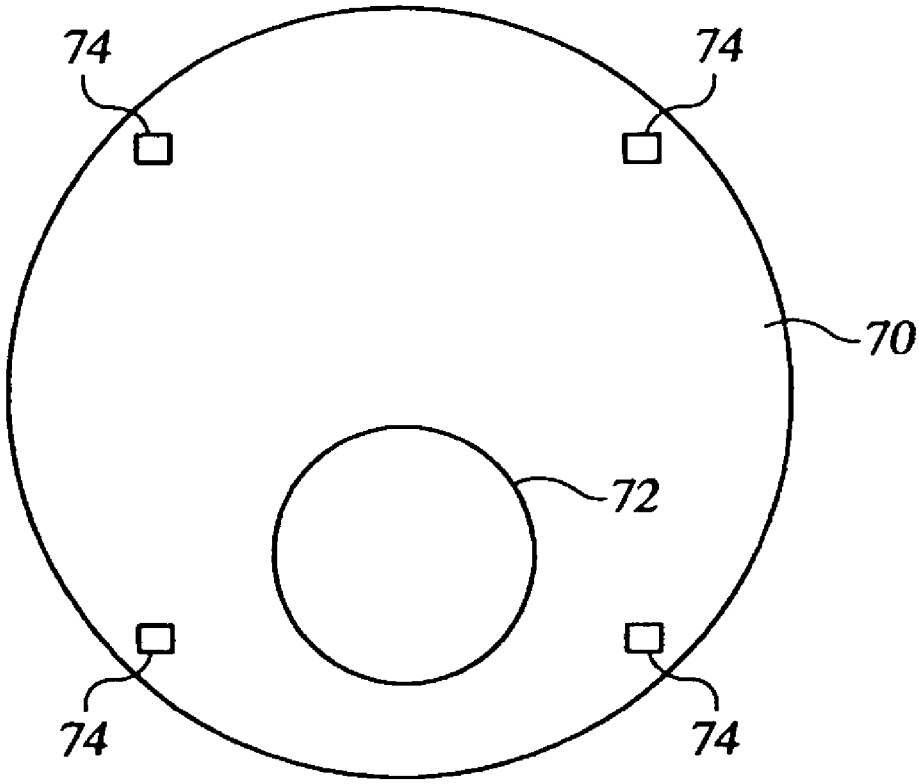
FIG. 9 depicts a removable flange of the present invention for a single pass plate and frame heat exchanger with the insertion port of the distribution/collection tube located off-center of the flange.

In some instances, not only one side of the plate and frame heat exchanger (requiring one fluid) but also both sides of the heat exchanger (two fluids) may need cleaning. Having blank flanges located at the four corners of the moveable frame plate will allow for insertion of the distribution/collection tubes, cleaning both sides of the heat exchanger independently. Regardless of the directional flow of the cleaning solution through the side being cleaned, which can be performed top-to-bottom or bottom-to-top, the flange plate connected at the bottom of the heat exchanger is designed to have the pipe located off the center of the flange towards the bottom. FIG. 9 depicts a nippled flange 70 of the present invention, with the nippled insert 72 for a distribution/collection tube located off-center. The flange is attached by symmetrically placed flange bolts 74. By rotating the flange plate, the nippled aperture can be skewed towards the bottom, top, left, or right. The lower 2-inch distribution/collection tube is then inserted with the apertures facing downwards. When the distribution/collection tube is located in the flange in the lowest position, as shown in FIG. 9, the arrangement allows for the maximum vacuuming capability of the system, acquiring heavier particles and debris that will ultimately collect at the bottom of the tube formed by the compressed plates. When the operational flow of the side being cleaned is bottom-to-top, preferably, the flange plate connected at the top of the heat exchanger should have the insertion pipe skewed towards the top. The distribution/collection tubes may then be inserted with the apertures upwards facing. This will allow for the heat exchanger to be as full as possible of cleaning solution, so that the maximum amount of plate surface is exposed to the solution and cleaned. In this configuration, there is no further need to vacuum heavy or larger particles and debris because they will have been trapped in the lower inlet tube of the heat exchanger, since these particles are too large to pass between any adjacent plates. The distribution/collection tube at the bottom of the heat exchanger removes this material.

When the operational flow of the side being cleaned is changed to traverse top-to-bottom, the flange plate connected at the top of the heat exchanger should have its insert pipe skewed towards the bottom. The 2-inch distribution/collection tube will then be inserted with the apertures facing downwards. This will vacuum particles and debris trapped in the upper tube of the heat exchanger, which in this case is the inlet tube. In this arrangement, the top section of the plates may not be completely exposed to the cleaning solution because the cleaning fluid may not rise high enough in the heat exchanger.

Since there is very little heat exchange that occurs at the top of the plates, it becomes more important to remove the particles and debris that would otherwise partially block the flow of fluid through the plate channels under normal operating conditions. The amount of heat exchange lost due to restricted flow caused by the particles and debris would be much greater than the heat exchange lost due to non-dissolved solids accumulated at the top of the plates.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An apparatus for cleaning a single pass plate and frame heat exchanger having a moveable frame plate end, said apparatus comprising:

said single pass plate and frame heat exchanger having at least two removable flanges having a center point and an off-center hole therethrough for installation of distribution/collection tubes, said flanges secured by bolting and positionable in at least four orientations such that said hole may be located above, below, left or right of said center point;

a lower distribution/collection tube with a plurality of apertures therethrough, said apertures including predetermined diameters and predetermined spacing, and said lower distribution/collection tube capable of being located off-center of said flange center point in at least four positions;

an upper distribution/collection tube with a plurality of apertures therethrough, said apertures including predetermined diameters and predetermined spacing;

a plurality of connecting hoses;

a portable pump connected to a reverse manifold valve network through a portion of said plurality of connecting hoses;

a circulation tank connected to said portable pump through a portion of said plurality of connecting hoses;

said upper and lower distribution/collection tubes connected to said reverse manifold valve network, each of said distribution/collection tubes connected through a portion of said plurality of connecting hoses;

a bag filter connected to said reverse manifold valve network and to said circulation tank.

2. The apparatus of claim 1 wherein said lower distribution/collection tube installed such that said apertures are downward facing and skewed downward off-center by placement of said flange.

3. The apparatus of claim 1 further comprising having said aperture predetermined diameter determined such that a cumulative aperture cross sectional area is approximately less than or equal to a cross sectional area of one of said distribution/collection tubes.

4. The apparatus of claim 1 comprising having said apertures of said upper distribution/collection tube downward facing when operational flow of said single pass plate and frame heat exchanger is in a top-to-bottom direction, and upwards facing when operational flow of said single pass plate and frame heat exchanger is in a bottom-to-top direction.

5. An apparatus for cleaning a single pass plate and frame heat exchanger having a movable frame end plate and a fixed frame end plate, said apparatus comprising:

said single pass plate and frame heat exchanger including at least two removable flanges on said movable frame end plate, said at least two removable flanges including an upper flange and a lower flange, said upper and lower flanges removed for insertion of at least one upper distribution/collection tube and at least one lower distribution/collection tube, respectfully;

a portable pump for pumping cleaning solution through said distribution/collection tubes into and out of said single pass plate and frame heat exchanger;

at least two distribution/collection tubes including said at least one upper distribution/collection tube and said at least one lower distribution/collection tube, each distribution/collection tube including a plurality of apertures having predetermined diameter and predetermined spacing, said at least two distribution/collection tubes aligned such that said apertures are in a generally downward facing direction in said at least one lower distribution/collection tube, and said apertures are downward facing in said at least one upper distribution/collection tube when operational flow of said single pass plate and frame heat exchanger is from top-to-bottom;

at least one bag filter designed to remove non-dissolved particles and debris from said cleaning solution;

a plurality of attaching hoses, said hoses designed to hold and carry said cleaning solution to and from a circulation tank, said bag filter, a reversing manifold, said pump, and said distribution/collection tubes within said single pass plate and frame heat exchanger;

said circulation tank connected to said bag filters; and said reversing manifold including a plurality of valves designed to reverse the flow of said cleaning solution from said bottom-to-top directional flow to said top-to-bottom directional flow with respect to said single pass plate and frame heat exchanger.

6. The apparatus of claim 5 wherein said removable flange plates are replaced with flange plates having a nippled formation adapted for insertion and connection of said distribution/collection tubes, such that said flange plates' nippled formation is capped under normal operation of said single pass plate and frame heat exchanger when said distribution/collection tubes are removed, said nippled formation being located off-center in at least one of said flange plates.

7. The apparatus of claim 5 including each of said distribution/collection tubes having a permanent flange plate attached thereto, such that said removable flange is replaced with said distribution/collection tube permanent flange plate when said distribution/collection tube is installed.

8. The apparatus of claim 5 further comprising having said aperture predetermined spacing evenly spaced about each of said distribution/collection tube's length, with an aperture at each end of said distribution/collection tube.

9. The apparatus of claim 8 wherein said apertures are spaced apart on said distribution/collection tube up to an approximate maximum of four inches.

10. The apparatus of claim 5 wherein said aperture predetermined spacing is analytically determined from said single pass plate and frame heat exchanger's plate pack length.

11. The apparatus of claim 5 further comprising having said aperture predetermined diameter determined such that a cumulative aperture cross sectional area is approximately less than or equal to a cross sectional area of one of said distribution/collection tubes.

12. The apparatus of claim 11 including having said aperture predetermined diameter be within a range approximate between ⅜ inches and ⅝ inches.

13. The apparatus of claim 5 wherein each of said distribution/collection tubes has approximately a 2-inch diameter.

14. The apparatus of claim 5 wherein said portable pump further includes 10-horsepower with a 2-inch outlet, said portable pump adapted to pump approximately 300 gallons per minute.

15. The apparatus of claim 5 wherein said at least one bag filter includes the capability of filtering 300 gallons per minute of said cleaning solution.

16. The apparatus of claim 5 further comprising said circulation tank having a capacity approximately in the range 150 to 200 gallons.

17. The apparatus of claim 5 including having four of said removable flanges, one at each corner of said single pass plate and frame heat exchanger.

18. The apparatus of claim 5 further including having said upper and lower distribution/collection tubes skewed off-center with respect to a center point of each of said flanges, with said distribution/collection tubes and said apertures directed towards said single pass plate and frame heat exchanger's bottom depending upon direction of said operational flow.

19. A method for cleaning a single pass plate and frame heat exchanger, having a moveable frame end plate and a fixed frame end plate, said method comprising:

shutting down said single pass plate and frame heat exchanger;

removing flanges from said single pass plate and frame heat exchanger from said moveable frame end plate;

installing upper and lower distribution/collection tubes in place of said removed flanges, such that apertures in said lower distribution/collection tube are generally downward facing;

connecting a reverse manifold valve network having a plurality of valves adaptable for forward and reverse directional flow of said cleaning solution to said upper and lower distribution/collection tubes at said single pass plate and frame heat exchanger;

connecting one end of a portable pump to a first port of said reverse manifold valve network and the other end of said portable pump to a circulation tank filled with cleaning solution;

connecting at least one bag filter at a first port to said upper distribution/collection tube at one end through a second port of said reverse manifold valve network and to said circulation pump at a second end at a second port of said at least one bag filter;

activating said portable pump to apply pressure to said cleaning solution to move said cleaning solution through said single pass plate and frame heat exchanger in a bottom-to-top directional flow;

changing said valves on said reverse manifold valve network to reverse the directional flow of said cleaning solution; and activating said portable pump to apply pressure to said cleaning solution to move said cleaning solution through said single pass plate and frame heat exchanger in a top-to-bottom directional flow.

20. The method of claim 19 further comprising installing said distribution/collection tubes such that said upper distribution/collection tube is skewed off-center of said flange, with apertures downward facing with respect to said single pass plate and frame heat exchanger when operational flow is in a top-to-bottom direction, and upwards facing when operational flow of said single pass plate and frame heat exchanger is in a bottom-to-top direction.

* * * * *